114-253 SR
4/8/80 OR 4,196,688

United States Patent [19]
Lipinsky, Sr.

[11] 4,196,688
[45] Apr. 8, 1980

[54] QUICK DEPLOYMENT MINE COUNTERMEASURE SWEEP GEAR

[75] Inventor: Robert J. Lipinsky, Sr., Huntington, Conn.

[73] Assignee: United Technologies Corporation, Hartford, Conn.

[21] Appl. No.: 106,276

[22] Filed: Jan. 13, 1971

[51] Int. Cl.[2] ..... B60P 3/00; B63B 21/56
[52] U.S. Cl. ..... 114/253
[58] Field of Search ..... 114/221 A, 235 B, 235 F, 114/235 R, 253; 244/3, 137 B

[56] References Cited

U.S. PATENT DOCUMENTS 3,159,806 12/1964 Piasecki ..... 114/235 B
3,248,074 4/1966 Cannon ..... 244/137 B

*Primary Examiner*—Stephen C. Bentley
*Assistant Examiner*—Thomas H. Webb
*Attorney, Agent, or Firm*—Vernon F. Hauschild

[57] ABSTRACT

Minesweep gear is suspended from an aircraft to be a selected height above the surface of the water for deployment and the sweep gear is selectively stowed within the container so that the sweep gear is selectively sequentially deployed with the sweep equipment which is to assume a position farthest from the towing aircraft being deployed first and the sweep equipment which is to assume a position closest to the towing aircraft being deployed last. The sweep lead wire is connected to the aircraft towing cable and, by remote control from the aircraft, the sweep gear can be so selectively deployed and thereafter towed by the aircraft, the container being jettisoned once the gear is deployed and the sweeping gear being jettisoned at the end of the sweeping operation.

24 Claims, 7 Drawing Figures

90
163
100
92
124
94
194
196
66
64
70
62
166
168
78
52
158
148
172
142
146
110
54
174
50
94
104
106
80
74
156
76
112
150
144
108
60
86
152
130
5

QUICK DEPLOYMENT MINE COUNTERMEASURE SWEEP GEAR

The invention herein described was made in the course of or under a contract as subcontract thereunder with the Department of the Navy.

BACKGROUND OF THE INVENTION

1. Field of Invention

This invention relates to minesweeping equipment and more particularly to minesweeping equipment which is expendable and which can be quickly deployed from a towing vehicle, such as a helicopter, and which is deployed sequentially from a jettisonable container suspended below the aircraft at a selective height above the water and which is connected to the helicopter towing cable and related towing gear.

2. Description of the Prior Art.

In the art of deploying and towing minesweep equipment from aircraft, the practice has been for aircraft crew members to sequentially deploy the minesweep equipment overboard from the aircraft and to pay-out and retrieve the minesweep equipment, wire and towing cable from hydraulic winches which are positioned aboard and controlled from within the aircraft. This method of deployment and operation is very time consuming, requires a substantial number of crew members, is dangerous to the crew members standing at the open hatches of the aircraft to deploy the gear, requires heavy equipment to deploy and retrieve the gear and reduces the total time of the sweep mission due to the excessive time used in deploying and retrieving the sweep gear.

SUMMARY OF INVENTION

A primary object of the present invention is to provide improved apparatus for deploying minesweep gear which permits rapid deployment of the gear from beneath an aircraft, such as a helicopter, which deployment gear is expendable, which towing gear is expendable so that no gear retrieval is required, which equipment is light in weight, which requires minimum deployment personnel, which produces minimal aerodynamic and hydrodynamic drag.

In accordance with the present invention, the minesweep equipment is selectively stowed in a container which has an open top and bottom and which is divided into a selective number of bays, and which includes a device, such as a jettisonable or pivotable panel or bar which is remotely controlled from the aircraft to be actuated to commence deployment and which supports the minesweep equipment so that the minesweep equipment is selectively sequentially deployed with the equipment which is to assume a streaming station farthest from the aircraft deployed first and so that the equipment which is to assume a sweeping station closest to the aircraft deployed last.

In accordance with a further aspect of the present invention, the minesweep equipment floats may be solid but are preferably inflatable in response to deployment motion of the minesweep equipment.

In accordance with still a further aspect of the present invention, the minesweep gear can be selectively prearranged in the carrying container through the open top of the container and is positioned by frangible mechanism, such as frangible wire or shear pins, so that the first-to-be deployed equipment is supported by the most frangible support mechanism and so that the last-to-be deployed is to be supported by the least frangible support mechanism.

In accordance with a further aspect of the present invention, the equipment can be prestowed in its container, a pallet may be used under a sweep gear container for storage and ground handling purposes and a cover may be placed over the container to protect the stowed gear from the elements.

In accordance with a further feature of this invention, due to the rapid deployment of the minesweep gear prior to the minesweeping towing operation and the jettisoning of the minesweep gear thereafter, the sweep mission time and the sweep area can be increased.

In accordance with a further aspect of the present invention, the minesweep gear is selectively stowed in a palletized container which can be positioned adjacent the towing helicopter on the take-off strip prior to departure from the sweeping area, with the lead wire thereof being connected to the helicopter towing cable, and with the container being connected to the helicopter for support in flight preferably through a plurality of cables which are connected to a stabilizer bar, which is in turn connected to the helicopter cargo hook, so that after the helicopter takes off, the sweep gear container is supported from the helicopter at a selected distance therefrom and with provisions to prevent container yaw during flight. The helicopter can then fly to the sweep area with the minesweep equipment so suspended and can come to selected altitude over the water surface at the sweep area so that the minesweep equipment container is a selected distance above the water surface and so that the minesweep gear can be selectively sequentially deployed from the minesweep container by remote control from the aircraft with the aircraft flying forward at a selected flight speed. The container can be jettisoned following deployment and the minesweep equipment can be jettisoned at the conclusion of the minesweep operation.

DESCRIPTION OF THE PREFERRED EMBODIMENT

Figure 1:
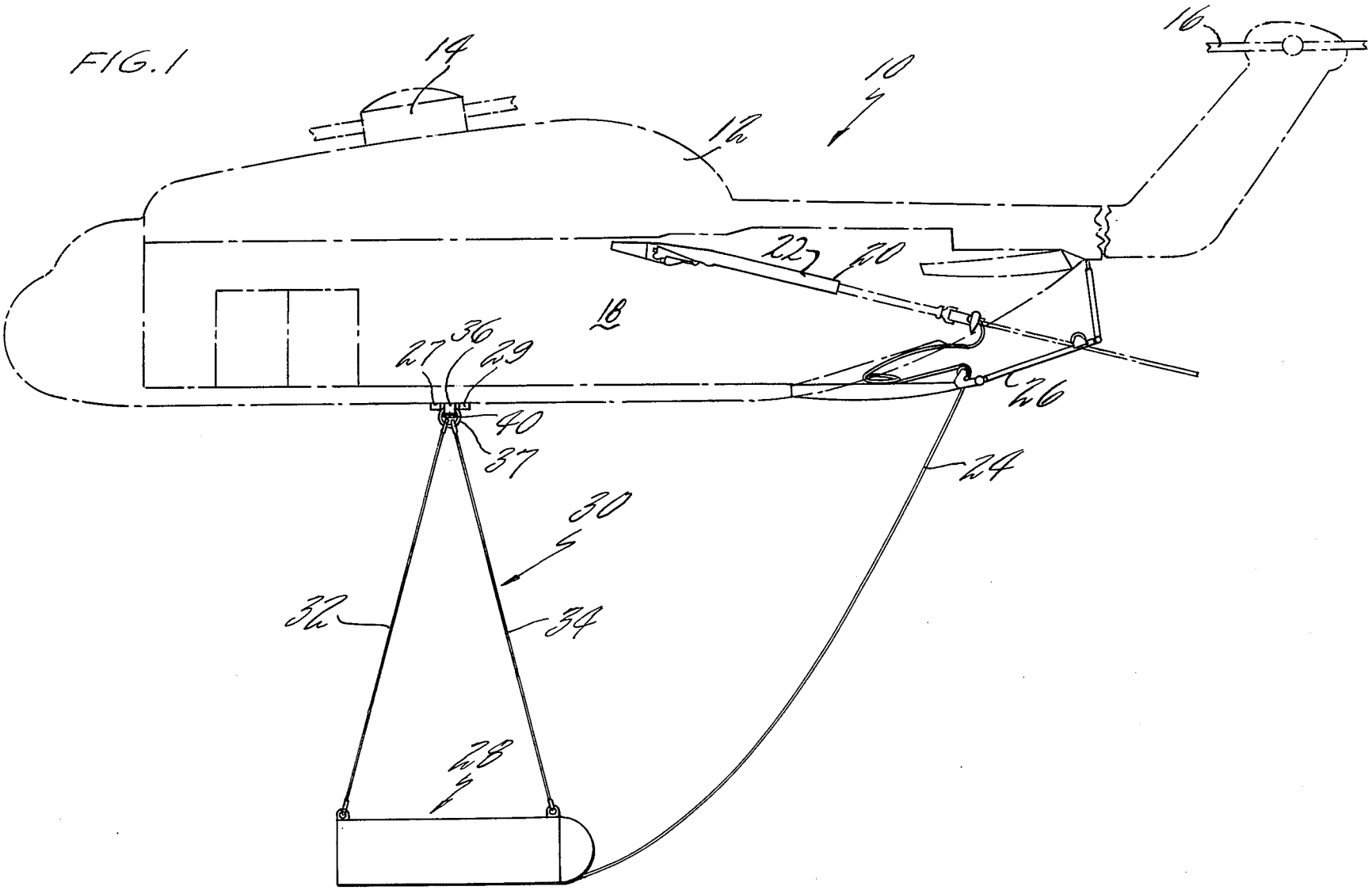
FIG. 1 is a side view of a helicopter with my quick-deployment minesweep gear suspended therefrom and connected to the helicopter tow equipment.

Referring to FIG. 1 we see aircraft 10, which is preferably a helicopter, and which consists primarily of fuselage 12, lift rotor 14 and tail rotor 16. Fuselage 12 defines cargo or passenger compartment 18 therewithin and conventional minesweep towing equipment 20 is located therein. Helicopter 10 is of the type more fully shown and described in U.S. Pat. No. DES. 197,823. Minesweep equipment 20 consists basically of a boom 22, which carries tow cable 24 from the end thereof, and tow guide mechanism 26. Tow equipment 20 may be of any conventional type but is preferably of the type shown and described in U.S. Pat. No. 3,438,596. Container 28, in which the minesweep equipment is stored as described thereinafter, is supported from helicopter 10 by cargo support cable mechanism 30 which preferably is the four-cable variety with cables 32 and 34 being pin connected to and extending from the port forward and after corners, respectively, of container 28 and being joined to one end of laterally extending, horizontal stabilizing bar 36 through ring 37. Forward and after cables corresponding to 32 and 34 are connected to forward and after starboard corners of container 28, respectively, and are so connected to the other end of stabilizer bar 36. External cargo hook 40 connects to stabilizer bar 36 at its midpoint. Cable mechanism 30 is of selected length so that container 28 is supported from helicopter 10 at an altitude or distance of about 10 feet above the surface of the water during the minesweep deployment operation. To prevent lateral rotation (yaw) of container 28, there are four stop members, such as 27 and 29, mounted rigidly to the underside of the aircraft to captivate the stabilization bar 36, keeping it and the container 28 indexed but allowing them to be released vertically.

Towing cable 24 connects to the after end of container 28 and more specifically to the lead wire therein and assumes the position shown in solid lines in FIG. 1 during the time when the helicopter is carrying the minesweep gear to the sweep area and assumes the position shown in phantom and designated as 24' during the minesweeping operation. It is preferable to allow a few coils, such as 42, in towing cable 24 when it is in its solid FIG. 1 line position.

Referring to FIGS. 2 through 7, we see gear stowage and deployment mechanism 28 in greater particularity. Gear mechanism 50, which is of conventional design and consists primarily of a lead wire 52 connected to tow cable 24 and with port and starboard sweep wires 54 and 56, respectively, connected thereto and projecting therefrom so as to cooperate therewith to form the letter "Y" and with each streaming wire carrying conventional floatation, cutting and controlling mechanism of the type to be described thereinafter. Container 60 is preferably a rectangular box which is open at its top and bottom. The open bottom provides the advantage of unobstructed sweeping gear deployment and the open top provides the advantage of accessability to the interior of the box for properly stowing the gear as required and as described hereinafter. Vertical separators 62 and 64 serve to divide the interior of box 60 into three bays or cavities 66, 68 and 70. Lead wire 52 and depressor 72 which is attached thereto, are stowed so as to be located in bay 68. Port wire 54 and inboard port otter 74 and outboard port otter 76, which are connected thereto, are stowed so as to be contained in bay 70, and starboard sweep wire 56, with corresponding otters, are stowed in bay 66 in the same fashion in which the port sweep gear is shown to be stowed in bay 70 in FIG. 2. The sweep wires have cutters 78, which may be of conventional design such as Mark 17 and Mark 19 cutters attached thereto, and these cutters serve the function of severing the mooring cable which supports the floating mines in a submerged condition from the floor of the body of water being swept. Depressor 72 and otters, such as 74 and 76, are of conventional design and consists of airfoil shaped or winged elements such as 80 and 82 to rudder element 84 and which are weighted or biased by mechanisms comparable to weight or ball 86 so that the depressor 72 serves to cause lead wire 52 to be towed beneath the surface of the water and so that the port and starboard otters perform a similar function on the port and starboard sweep wires and further serve to cause these wires to maintain their generally Y shape. In addition to the otters and cutters just mentioned, float mechanisms are also provided as part of the sweep gear 50. Lead float 90, port inboard and outboard floats 92 and 94 and starboard inboard and outboard floats 96 and 98 are connected in convenient fashion to the exterior of one side, and preferably the downstream side 100 of container 60. The operation of floats 90–98 will be described hereinafter.

Sweep gear 50 which consists of lead wire 52, port wire 54 and starboard wire 56 and their cutter, depressor, otter and float attachments enumerated above, is selectively stowed into container 60 so that the sweep equipment 50 will be selectively sequentially deployed so that the gear which is to assume a sweeping station farthest from the aircraft, in this instance, the port and starboard outboard otters, such as 76, will be deployed first and symmetrically, with the corresponding equipment on the port wire 54 being simultaneously deployed with the corresponding equipment on starboard wire 56. Lead wire 52 and its attached equipment will be deployed after both port and starboard wires 54 and 56 with their attachments have been deployed.

To insure this manner of selective sequential deployment, the sweep gear 50 is stowed in container 60 in a fashion now to be described.

Figure 2:
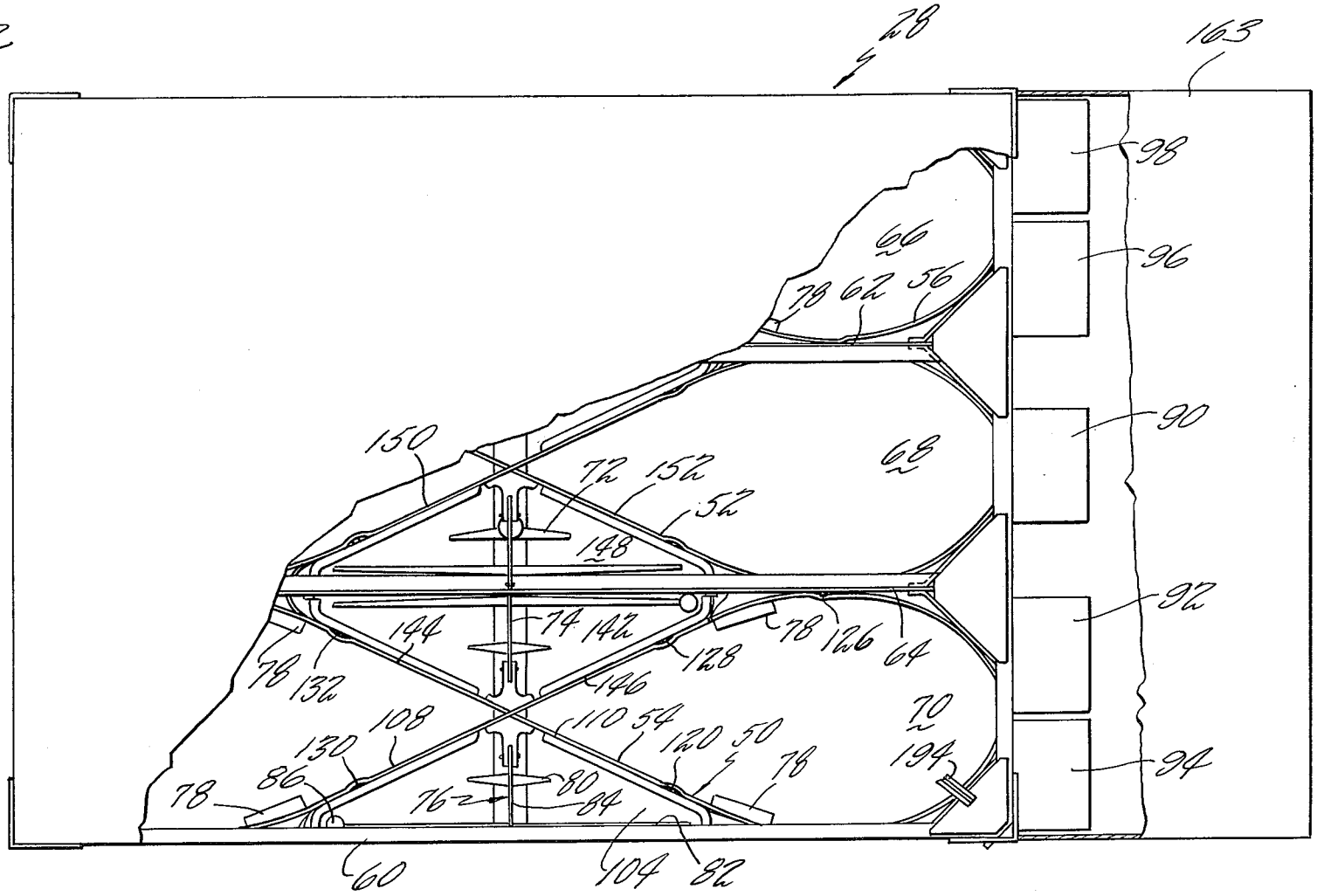
FIG. 2 is a top view of the minesweep gear selectively stowed in its container.
Figure 3:
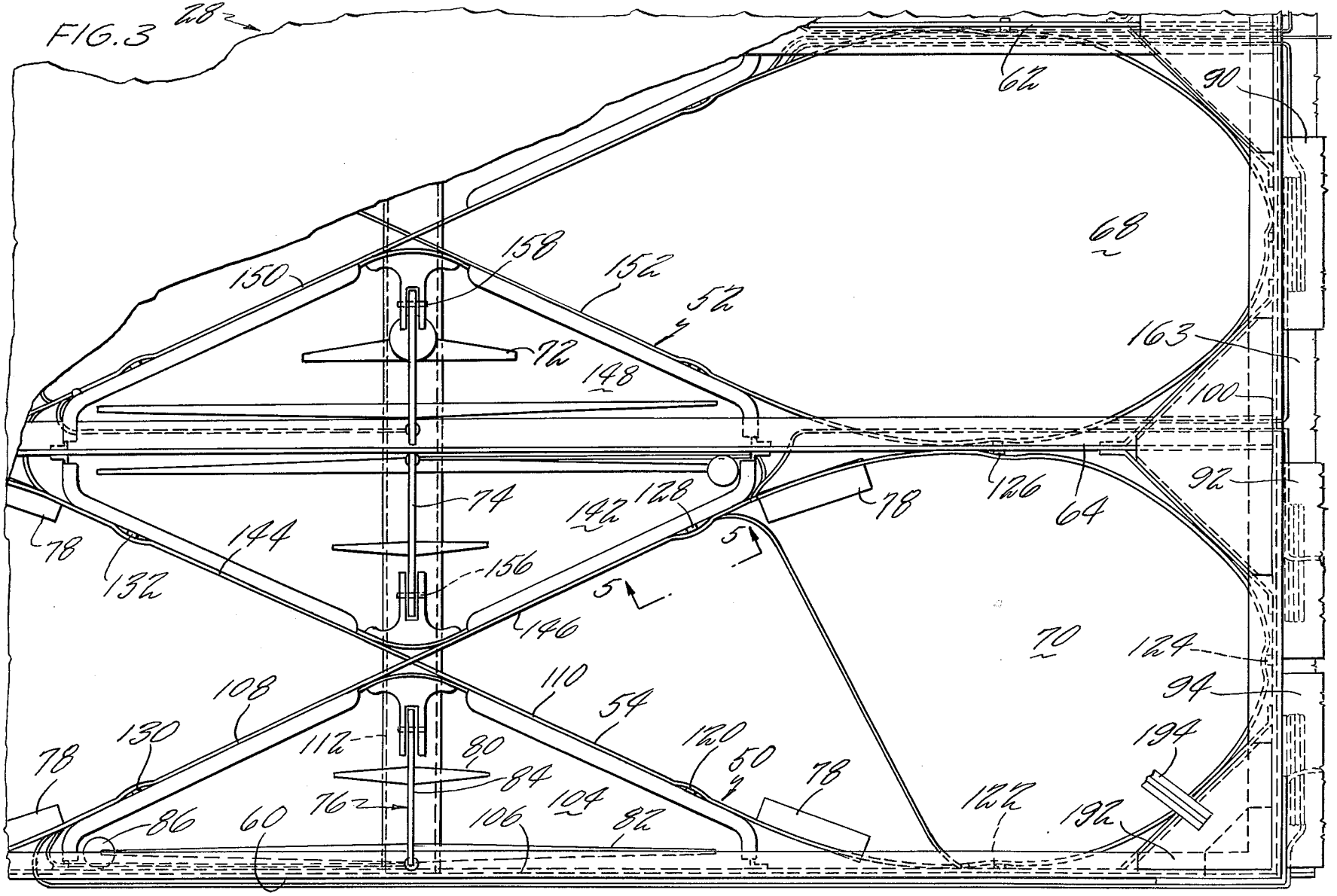
FIG. 3 is an enlargement of a portion of FIG. 2.
Figure 5:
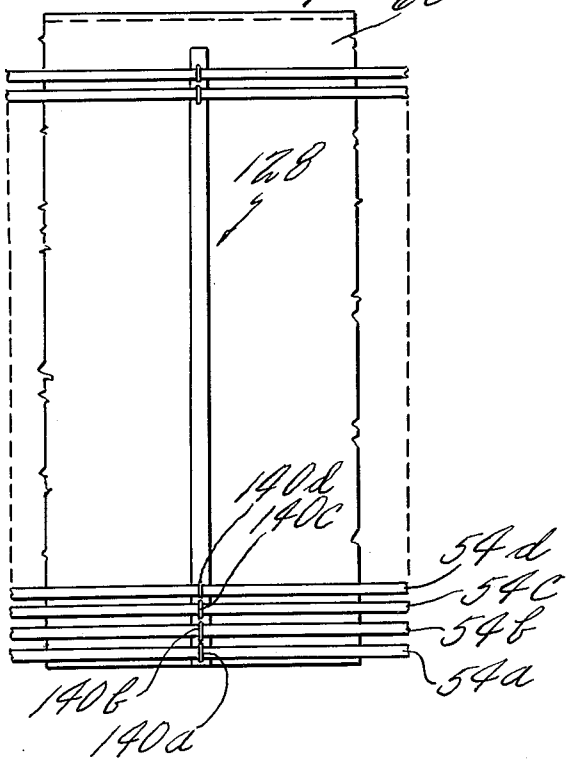
FIG. 5 is a view taken along line 5—5 of FIG. 3.

The outboard port and starboard otters, such as 76, are positioned in corresponding bays, such as 104, formed between wall 106 of container 60 and supplemental partitions 108 and 110 thereof so as to be supported by support bar 112 only. Port and starboard sweep wires 54 and 56 are then symmetrically coiled in bays 66 and 70 in FIG. 8 formations as shown in FIG. 2 and in layers such as shown in FIG. 5. Sweep wire is supported at stations throughout its length, such as stations 120, 122, 124, 126, 128, 130 and 132 and are held in position at each of these stations as best shown in FIG. 5. FIG. 5 depicts station 128 and depicts the port sweep wire 54 in successive vertical layers 54*a*, 54*b*, 54*c* and 54*d* and other similar layers as necessary, such that each layer 54*a*–54*d* is supported by a frangible mechanism, such as frangible wires 140*a*, 140*b*, 140*c*, and 140*d*, or other frangible mechanism, such as shear pins. It is important to the teaching of this invention that these frangible mechanisms 140*a*–140*d* are selected such that the frangible mechanism 140*a* which supports the first-to-be deployed portion of wire 54 be more frangible than frangible retention mechanism 140*b*, which supports the second-to-be portion of wire 54. In similar fashion, frangible mechanism 140*c* is less frangible than 140*b* and frangible mechanism 140*d* is less frangible than mechanism 140*c*. The fact that the most frangible retention mechanism 140*a* supports the first-to-be deployed portion of wire 54 insures that the pull of the sweep gear already deployed will rupture frangible mechanism 140*a* before frangible mechanism 140*b*, 140*b* before 140*c*, 140*c* before 140*d*, and so on. Further, since the total hydrodynamic force of the water acting on the equipment increases as more equipment is deployed, ever increasing forces will become available to rupture the increasingly less frangible support members supporting the last-to-be deployed minesweep gear. Port and starboard sweep wires 54 and 56 continue to be so layered and retained until each of these wires with their attachments, for example cutter 78, otters 74 and 76 and floats 92 and 94 for port wire 54, are completely so stowed and then lead wire 52 is so stowed in bay 68 in similar fashion, together with its depressor 72 and float 90. It will be noted that inboard port otter 74 is stowed in bay 142 formed by auxiliary partitions 144 and 146 and partition 64 while depressor 72 is housed in bay 148 formed by auxiliary partitions 150 and 152 and partition 64.

Figure 7:
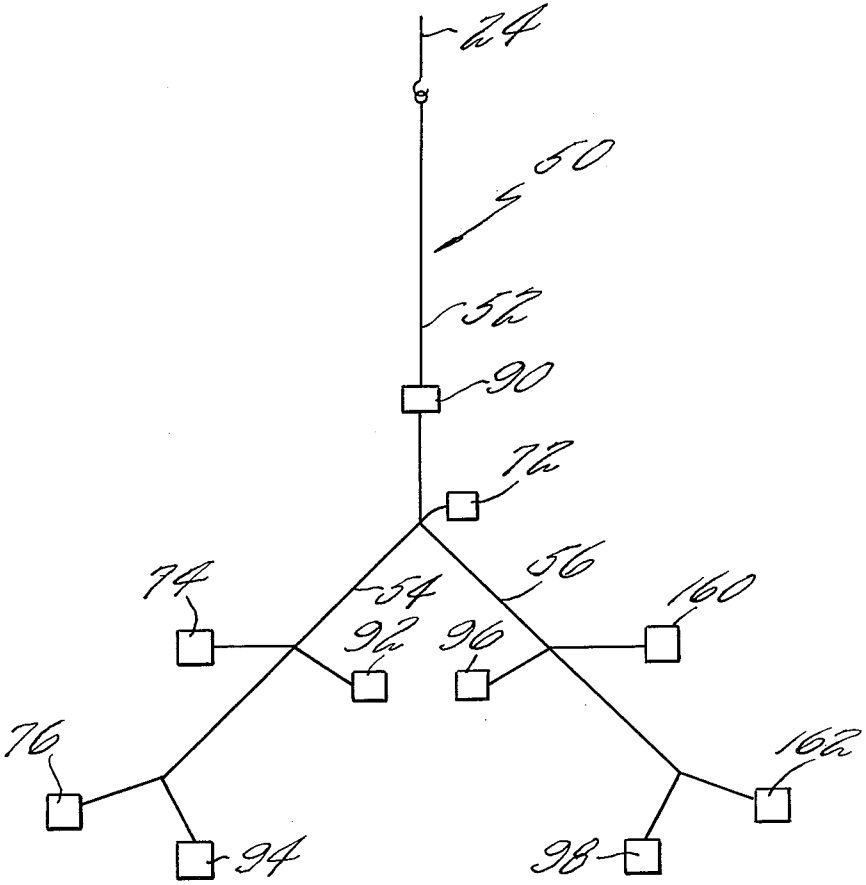
FIG. 7 is a showing of the minesweep equipment in streaming position.

It will be realized that the equipment attached to starboard sweep wire 56 is identical, and preferably allochiral, with the equipment attached to port sweep wire 54 and is similarly stored. The stowage of port wire 54 and its associated mechanism only is described herein for purposes of simplification. Inboard otters, such as 74, are retained by shear pins such as 156 and depressor 72 is retained by shear pin 158 and these shear pins are of selected frangibility to cooperate with frangible mechanisms 140*a*–140*d* to insure that sweep gear 50 is deployed selectively sequentially in the required order to produce the Y shape formation shown in FIG. 7. In FIG. 7, the wires, otters, and floats already described are identified by the reference numerals already used, and the inboard and outboard starboard otters are identified by reference numerals 160 and 162.

Figure 4:
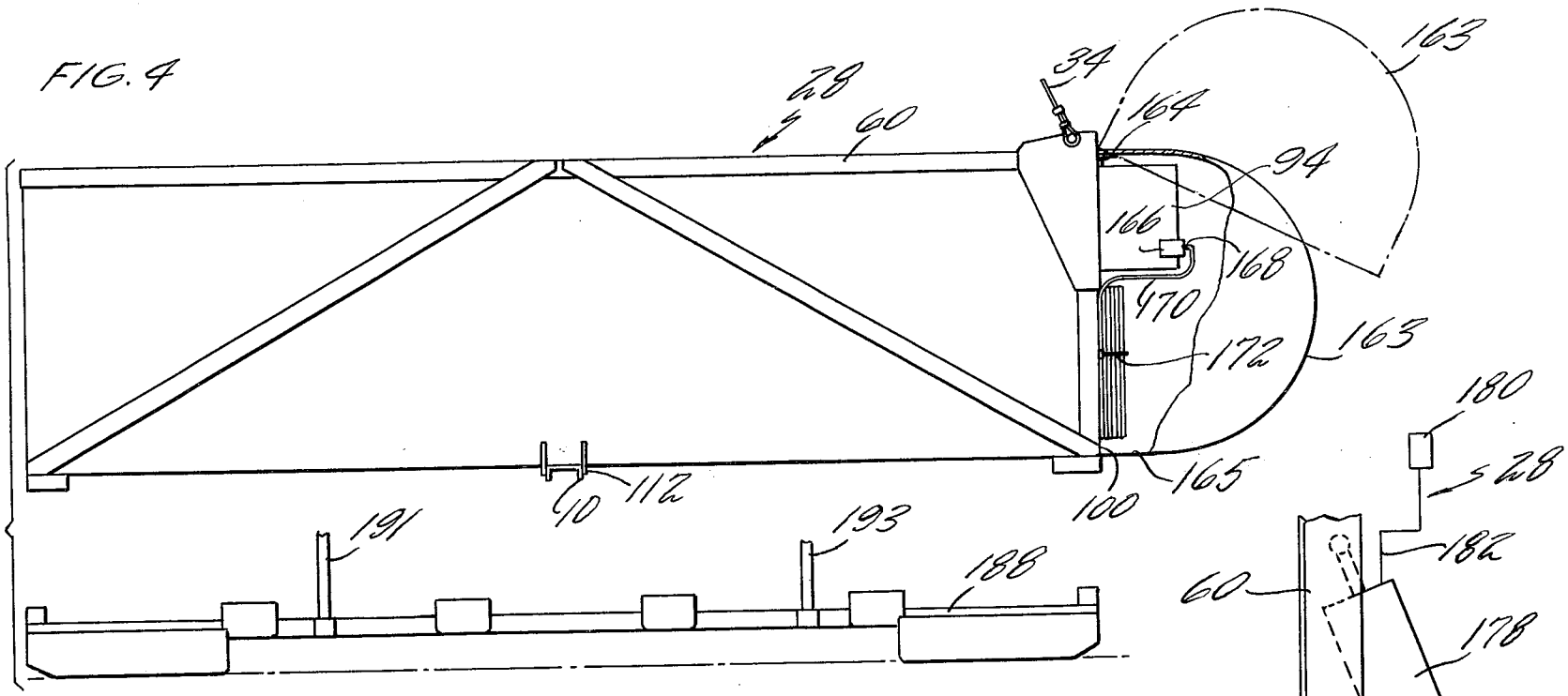
FIG. 4 is a side view of the minesweep equipment container.

Floats 90–98 are connected in convenient conventional fashion to the downstream side 100 of container 60 and are preferably covered by cover mechanism 63, which is shown in FIGS. 2 and 4. The cover is substantially semicircular in cross-section and is pivotally connected to container 60 by hinges 164 and is pivotable between its FIG. 4 phantom line position to permit installation of floats 90–98, and to its FIG. 4 solid line position to protect the floats and associated mechanism. Cover 63 has an open bottom portion 165 to permit floats 90–98 to drop therethrough during the minesweep deployment operation. Floats 90–98 are of the inflatable type and each contain an inflation mechanism, such as a $CO_2$ container 166 or other conventional mechanism. The depicted inflation mechanism 166 is actuated by the pulling of pin 168 from $CO_2$ container 166 in rip-cord fashion by cord 170. One end of cord 170 is connected to pin 168 and the other end of the cord is connected to container 60 while the central portion of the cord is stowed, preferably in FIG. 8 fashion, and connected by frangible connecting mechanism 172, to the exterior of container 60 at wall 100. Accordingly, as sweep wires 54 and 56 pull each float free of container 60 during the minesweep deployment operation, the float moves away from container 60 causing the rip-cord 170 to break free of frangible retainer 172 and when rip-cord 170 reaches its full length, it will serve to pull actuating pin 168 from $CO_2$ container 166 so as to inflate its associated float, such as float 94 shown in FIG. 4. It will therefore be seen that floats 90–98 are inflatable in response to sweep gear deployment motion.

Figure 6:
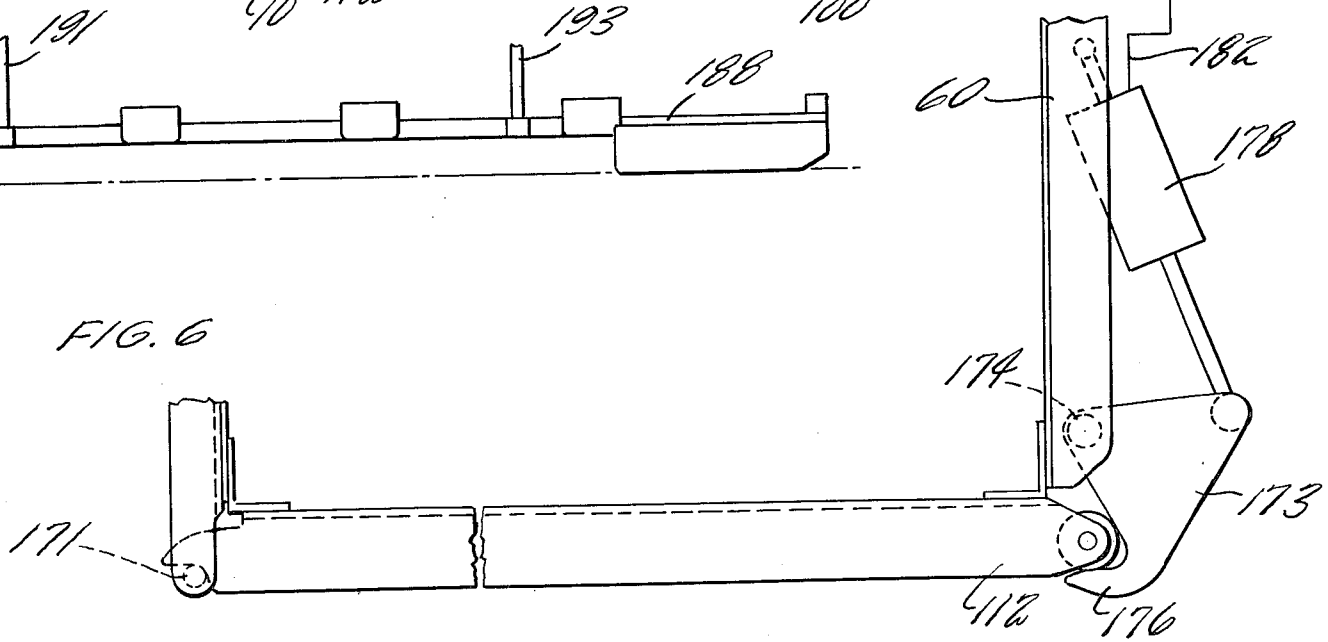
FIG. 6 is a showing of the minesweep equipment deployment commencement mechanism and its operating mechanism.

As best shown in FIG. 6, support bar 112 extends across the bottom of container 60 laterally and is pivotally connected at pivot point 171 to one wall thereof and is supported at its opposite end by release lever 173 which is connected to container 60 at pivot point 174 and which includes hook portion 176 which engages and supports one end of support bar 112. Electric actuator 178, which may be a solenoid or other conventional actuator, is operable remotely from the cockpit through actuator switch 180 which is electrically connected by lead mechanisms 182 to actuator 178. It will be seen by viewing FIG. 6 that when the operator actuates gear deployment actuation switch 189 in aircraft 10, electric actuator 178 actuates to trip release mechanism 173 and thereby free one end of support bar 112 so that the end immediately commences falling and almost simultaneously frees the opposite end thereof from pivot point 171. Since the outboard port and starboard otters 76 and 162 are supported by support bar 112 only, the jettisoning of support bar 112 in this fashion makes these otters free falling and this commences the deployment of sweep gear 50. In view of the selective frangible retention of the remainder of gear 50, the gear will then be deployed from container 60 such that inboard port and starboard otters and floats 74, 92, 96, and 160 are next simultaneously deployed, so that depressor 72 is next simultaneously deployed and so that lead float 90 is last deployed so as to form the streaming formation shown in FIG. 7.

As best shown in FIG. 4, for ground handling and storage purposes, container 60 is fabricated so as to be easily supported upon pallet mechanism 188 for fork-lift and other type of moving. Preferably, a cover mechanism 190 is placed over the open top of container 60 and comprises an aluminium or canvas sheet connected to the corner supports, such as 192 of container 60 by the insertion of support bars 194 thereunder. Cover 190 serves to protect the contents, when stowed selectively as shown in FIG. 2, from the elements and possible mechanical damage.

In preparing for a minesweeping mission, the following sequence of steps is followed. The sweep gear 50 stowed in the container 60 is positioned in any convenient fashion adjacent the helicopter. Strap mechanisms 191 and 193, which connect the fully equipped container 60 to pallet 188 are then removed. Container cable support mechanism 30 is then installed so that the four corners of container 60 are connected to the aircraft external cargo hook 40 through the four cables 32–34, and spreader bar 36. The helicopter tow cable 24 is then attached to lead wire 52. The electrical connection between support beam release actuator 178 and switch 180 is then made to permit pilot actuation thereof. The helicopter then becomes airborne and lifts container 60 off the ground. The helicopter then flies with the container assembly 28 so suspended, preferably about 40 feet below the fuselage, to the deployment area at approximately 80 knots. When at the deployment area, the helicopter's forward speed relative to the water is reduced to approximately 10 knots and the altitude of the container and deployment mechanism 28 is maintained approximately 10 feet above the surface of the water. In helicopters of the type shown in FIG. 1, ramp 196 is then lowered to its horizontal position and the tow boom 20 is lowered thereonto. The pilot then actuates the deployment commencement switch 180 which serves to commence deployment of gear 50 as described above in the following sequence: outboard otters, outboard floats, outboard sweep wires and pendants, inboard otters, inboard floats, inboard sweep wires and float pendants, depressor, lead float, and lead wire. When all of the minesweep gear 50 has been so deployed from the base of container 60, stabilization bar 36, the tow boom mechanism 22 will react the tow forces and the gear will be accelerated to the velocity of the helicopter. At this point in the mission, the empty container 60 is jettisoned from hook 40 and the container 60 and sling assembly 30 fall to the water and sink since the container is preferably made of lightweight metal, plastic or the like.

The minesweep gear deployment operation has now been accomplished and the minesweep operation commences. When the minesweeping operation is completed, the sweep gear 50 can be jettisoned at boom 22 and will be sunk by damaging the floats and will then sink in the water due to its own weight. Because of the rapid means of deployment and the fact that the sweep gear is not retrieved following the minesweeping operation, substantial time is saved and the duration of the sweeping mission and the area which the sweeping operation can cover are increased and the number of personnel required to deploy and carryout the sweeping operation is substantially reduced.

I wish it to be understood that I do not desire to be limited to the exact details of construction shown and described, for obvious modifications will occur to a person skilled in the art.

I claim:

1. Quick deploy minesweep apparatus including:

(A) container means in which the minesweep equipment is selectively stowed and including:

(1) means to stow minesweep equipment so as to be deployed selectively so that the gear which is to assume a sweep position farthest from the towing vehicle is deployed first and so that the minesweep equipment is successively sequentially deployed so that the minesweep equipment which is to assume a position nearest to the towing vehicle is deployed last.

2. Apparatus according to claim 1 and including means to commence the deployment of the sweep gear.

3. Apparatus according to claim 2 wherein said deployment commencement means is remotely controlled.

4. Apparatus according to claim 1 and including a sweep gear comprising: at least one sweep wire with at least one float and at least one otter connected thereto.

5. Apparatus according to claim 4 wherein said float is inflatable.

6. Apparatus according to claim 5 and including means to cause said float to inflate in response to minesweep deployment motion.

7. Apparatus according to claim 6 wherein said stow means includes members of selected frangibility so that the first to be deployed sweep equipment is mounted to be free falling and wherein the sweep equipment which is to be sequentially selectively deployed thereafter is retained by frangible members such that the earliest-to-be deployed gear is supported by the most frangible members and the last-to-be is supported by the least frangible members.

8. Apparatus according to claim 3 wherein in said container means is a multi-sided box with an open bottom and wherein said deployment commencement means includes a pivotable support member pivotally connected to said box so as to be pivotable between a first position wherein it cooperates within said box in retaining the minesweep equipment therein and wherein said pivotable member comprises the sole retention means for the first-to-be deployed minesweep equipment and a second position wherein the first to be deployed minesweep equipment is freed for falling through the open bottom of said box.

9. Apparatus according to claim 7 wherein said most frangible members are shear wires and wherein said least frangible are shear pins.

10. Apparatus according to claim 8 and including minesweeping gear comprising:

(A) a lead wire having at least one lead float and at least one wire depressor attached thereto, (B) a starboard sweep gear connected to said lead wire and having at least one sweep wire with at least one marker float, at least one otter, and at least one mine mooring cable cutter attached thereto, and (C) a port sweep gear connected to said lead wire and having at least one sweep wire with at least one marker float, and at least one otter, and at least one mine mooring cable cutter attached thereto, (D) and wherein the plural sided box of said container means is divided into three compartments and wherein said minesweep equipment stow means stows said lead wire in its attachment in one of said compartments, said starboard sweep wire and its attachments in another of said compartments, and said port sweep wire and its attachments in the third of said compartments, and wherein said deployment commencement means causes said port and starboard sweep wires and their attachments to be deployed simultaneously and symmetrically.

11. Apparatus according to claim 10 wherein said sweep wires, said cutters, and said otters are stowed within said container means, and wherein said floats are supported from the exterior from said container means.

12. In combination:

(A) an aircraft adapted to tow floating-minesweeping equipment, (B) quick deployment minesweep apparatus including:

(1) container means in which the minesweep equipment is selectively stowed and including:

(a) means to stow minesweep equipment so as to be deployed selectively so that the gear which is to assume a sweep position farthest from the aircraft is deployed first and so that the minesweep equipment is successively sequentially deployed so that the minesweep equipment which is to assume a position nearest to the aircraft is deployed last, (C) and means to suspend said quick deploy minesweep apparatus a selected distance below said aircraft.

13. Apparatus according to claim 12 wherein said suspension means includes:

(A) a hook member projecting downwardly from said aircraft, (B) first cable means connected to said hook and extending downwardly a selected distance therefrom, (C) a stabilizer bar connected to and supported by said first cable means, (D) yaw restraint means operable to restrain said stabilizer bar against motion in yaw, and (E) second cable means connecting the opposite ends of said stabilizer bar to said container means.

14. Apparatus according to claim 12 and including means controllable from said aircraft to commence the deployment of the sweep gear.

15. Apparatus according to claim 1 and including a sweep gear comprising at least one sweep wire with at least one float and at least one otter connected thereto, and wherein said float is inflatable, and including means to cause said float to inflate in response to minesweep deployment motion.

16. Apparatus according to claim 12 wherein said stow means includes members of selected frangibility so that the equipment which is to be sequentially selectively deployed is retained by frangible members such that the earliest-to-be deployed gear is supported by the most frangible members and the last-to-be deployed gear is supported by the least frangible members.

17. Apparatus according to claim 11 and including cover means for said container means, and cover means for said floats.

18. Apparatus according to claim 1 wherein said container means has an open bottom and is shaped to be positioned on and connected to a pallet for storage and ground handling purposes.

19. Apparatus according to claim 1 wherein said equipment stow means includes frangible support members of selected frangibility so that the first-to-be deployed equipment receives minimal support and so that the last-to-be deployed equipment receives maximum support.

20. Apparatus according to claim 1 wherein said equipment stow means includes frangible supports for various portions of the equipment so selected that each portion of the equipment is supported by means more frangible than the portion of the equipment to be deployed immediately thereafter.

21. Apparatus according to claim 3 wherein said container means is a multi-sided box with an open bottom and wherein said deployment commencement means includes a support member extending across at least a portion of the bottom of said box and mounted thereof so as to be jettisonable to commence minesweep equipment deployment.

22. Apparatus according to claim 1 and including means to suspend said quick deploy minesweep apparatus a selected distance below an aircraft for transporting deployment and sweep towing therefrom.

23. Apparatus according to claim 22 wherein said suspension means includes:

(A) first cable means adapted to be releasably connected to an aircraft and extend downwardly a selected distance therefrom, (B) a stabilizer bar connected to and supported by said first cable means, and (C) second cable means connecting the opposite ends of said stabilizer bar to said container means.

24. The method of sweeping from a helicopter the mines moored in a body of water comprising the steps of:

(A) prepackaging the minesweep gear in a container using selected support equipment so that the first-to-be deployed portion of the minesweep equipment can be deployed remotely and thereby commence deployment of the remainder of the equipment, (B) positioning the prepackaged minesweep gear in its container adjacent a helicopter and attaching the container to the helicopter cargo hook so that it will be suspended a selected distance beneath the helicopter during flight and attaching the minesweep gear to the helicopter towing apparatus (C) flying the helicopter with the prepackaged minesweep gear and container so positioned and supported to the sweep area, (D) passing over the sweep area at slow speed and with the prepackaged minesweep gear and container a selected distance above the water surface, (E) selectively deploying the prepackaged minesweep gear by commencing deployment remotely from the aircraft, (F) jettisoning the container when the minesweep gear is deployed and being towed by the aircraft, (G) sweeping the area to be swept, and (H) jettisoning the minesweep gear.

* * * * *